US009447633B2

(12) United States Patent
Lang et al.

(10) Patent No.: US 9,447,633 B2
(45) Date of Patent: Sep. 20, 2016

(54) DEVICE FOR ROLLING UP AND UNROLLING A MATERIAL WEB ONTO AND FROM A SHAFT

(71) Applicant: SHADESIGN GMBH & CO. KG, St. Magdalen (AT)

(72) Inventors: Peter Lang, Graz (AT); Florian Aulinger, Hohenthann (DE)

(73) Assignee: SHADESIGN GMBH & CO. KG, St. Magdalen (AT)

( * ) Notice: Subject to any disclaimer, the term of this patent is extended or adjusted under 35 U.S.C. 154(b) by 0 days.

(21) Appl. No.: 14/379,400

(22) PCT Filed: Feb. 21, 2013

(86) PCT No.: PCT/EP2013/000512
§ 371 (c)(1),
(2) Date: Aug. 18, 2014

(87) PCT Pub. No.: WO2013/124067
PCT Pub. Date: Aug. 29, 2013

(65) Prior Publication Data

US 2015/0034261 A1 Feb. 5, 2015

(30) Foreign Application Priority Data

Feb. 24, 2012 (DE) ..... 10 2012 003 524

(51) Int. Cl.
*A47G 5/02* (2006.01)
*A47H 1/00* (2006.01)
(Continued)

(52) U.S. Cl.
CPC . *E06B 9/44* (2013.01); *E06B 9/42* (2013.01); *E06B 9/64* (2013.01); *E04F 10/02* (2013.01); *E04F 10/0648* (2013.01); *E06B 2009/405* (2013.01)

(58) Field of Classification Search
CPC ..... E06B 9/42; E06B 9/44; E06B 2009/405; E06B 9/64; E04F 10/02; E04F 10/0607; E04F 10/0644; E04F 10/0692; E04F 10/0666; E04F 10/0681; E04F 10/0655
USPC ..... 160/243, 245, 277, 319, 244, 246, 253
See application file for complete search history.

(56) References Cited

U.S. PATENT DOCUMENTS 238,925 A * 3/1881 Landon ..... E06B 9/40 160/241
262,398 A * 8/1882 Gerard ..... E06B 9/68 160/265

(Continued)

FOREIGN PATENT DOCUMENTS

CN 2743518 Y 11/2005
CN 101778990 A 7/2010

(Continued)

OTHER PUBLICATIONS

Chinese Search Resort issued in Application No. 201380010488.X dated Jul. 3, 2015 (translation).

(Continued)

*Primary Examiner* — Katherine Mitchell
*Assistant Examiner* — Jeremy Ramsey
(74) *Attorney, Agent, or Firm* — Nixon & Vanderhye P.C.

(57) ABSTRACT

The present invention discloses a device for rolling up and unrolling a material web (2) on a shaft (1, 15). The device is distinguished by the fact that a first radial spacing (R1) of the material web (2) from a rotational axis of the shaft (1, 15), which first radial spacing (R1) is assigned to any desired unrolled length (L) of the material web (2), differs from a second radial spacing (R2) of a tensioning cable (3, 16) from the rotational axis of the shaft (1, 15), which second radial spacing (R2) is assigned to said unrolled length (L), with the result that the direction and magnitude of a first torque which is exerted on the shaft (1, 15) via the material web (2) differ from those of a second torque which is exerted on the shaft (1, 15) via the tensioning cables (3, 16), in such a way that, on account of the torque difference between the first torque and the second torque, the shaft (1, 15) is driven by a force (F) which is transmitted by means of the tensioning cables (3, 16).

15 Claims, 5 Drawing Sheets

(51) Int. Cl.

| | |
|---|---|
| ***E06B 9/44*** | (2006.01) |
| ***E06B 9/42*** | (2006.01) |
| ***E06B 9/64*** | (2006.01) |
| *E04F 10/06* | (2006.01) |
| *E04F 10/02* | (2006.01) |
| *E06B 9/40* | (2006.01) |

(56) References Cited

U.S. PATENT DOCUMENTS

| | | | | |
|---|---|---|---|---|
| 862,644 | A * | 8/1907 | Kepler | E06B 9/36 160/243 |
| 1,486,678 | A * | 3/1924 | Peters | E06B 9/66 160/241 |
| 6,874,559 | B1 | 4/2005 | Hicks | |

FOREIGN PATENT DOCUMENTS

| | | | |
|---|---|---|---|
| DE | 681 428 | | 9/1939 |
| DE | 40 38 419 | A1 | 6/1991 |
| EP | 2 371 592 | A1 | 10/2011 |
| FR | 2 787 826 | A1 | 6/2000 |
| JP | 9-328979 | A | 12/1997 |
| WO | WO 92/06268 | | 4/1992 |

OTHER PUBLICATIONS

International Search Report for PCT/EP2013/000512 mailed May 24, 2013.

Written Opinion of the International Searching Authority for PCT/EP2013/000512 mailed May 24, 2013.

* cited by examiner

DEVICE FOR ROLLING UP AND UNROLLING A MATERIAL WEB ONTO AND FROM A SHAFT

This application is the U.S. national phase of International Application No. PCT/EP2013/000512 filed 21 Feb. 2013 which designated the U.S. and claims priority to DE 10 2012 003 524.1 filed 24 Feb. 2012, the entire contents of each of which are hereby incorporated by reference.

The present invention relates to a device for rolling up and unrolling a material web onto and from a shaft in accordance with the preamble of claim 1. Devices of this type may be used as a shading device, screen device and/or demarcation device.

In the devices known in the art for rolling up and unrolling a material web onto and from a shaft, a first fastening end of the material web is conventionally fastened to a holding structure, for example to a window beam or to a wall. At a second fastening end, opposite the first fastening end, the material web is fastened to a circumference of the shaft in such a way that by rotation about an axis of rotation and symmetry the material web is rolled up and unrolled on a central portion of the shaft, depending on the direction of rotation of the shaft. For guiding or tensioning the shaft, it has a rim portion in each of the two axial end regions, a tensioning rope in each case being fastened to the respective circumferences of the rim portions. The tensioning ropes can be rolled up and unrolled on the respective rim portions by rotating the shaft, depending on the direction of rotation. The material web is fastened to the circumference of the central portion of the shaft and the tensioning rope is fastened to the circumferences of the rim portions of the shaft in such a way that the shaft moves away from the holding structure as a result of the shaft being rotated in an unrolling direction and the material web unrolls from the central portion of the shaft, the tensioning ropes being rolled up on the respective rim portions of the shaft during this unrolling rotation of the shaft. By contrast, if the shaft is rotated in a rolling-up direction counter to the unrolling direction, the shaft moves towards the holding structure and the material web is rolled up onto the central portion of the shaft, the tensioning ropes being unrolled from the respective rim portions of the shaft during this rolling-up rotation of the shaft.

In an arrangement in which the material web is to be unrolled from the shaft in the vertical direction, the shaft is driven by the gravity acting thereon and set in rotation, causing the material web to unroll from the shaft. By contrast, once the device has been mounted in such a way that the material web is to roll out obliquely or evenly horizontally, the shaft is still only driven insufficiently by the gravity acting thereon, and so the shaft has to be rotated by hand or by a motor.

During the unrolling movement of the shaft, in which the planar material unrolls from the shaft, the radial distance of the planar material from the axis of rotation decreases with increasing roll-out length. If the radial distance of the tensioning ropes from the axis of rotation remained constant during the unrolling movement of the shaft, the tension of the planar material would depend on the roll-out length. To make the material web remain uniformly tensioned irrespective of the roll-out length thereof from the shaft, the rim regions of the shaft are of a conical shape such that irrespective of the roll-out length of the planar material the radial distance of the tensioning ropes from the axis of rotation is always identical to the radial distance of the planar material from the axis of rotation.

In a device of this type known in the art, the shaft has to be driven either by hand or by a motor, for example via a separate Bowden cable, which is for example connected to an end face of the shaft in the region of the axis of rotation thereof so as to be rotatable.

The devices known in the art thus have a large number of components so as to have satisfactory functionality. As a result, devices of this type are expensive to manufacture and complicated to install. Further, these devices are highly fault-prone because of the large number of components.

Thus for example DE 681428 discloses a drive mechanism for the rolling and winding-up means on roller blinds for banks of window in blackout devices, the roller blind being fastened in a clamping strip above the window and being wound up on a roller bar which also serves as a bottom bar. The roller bar can be rolled up and unrolled by way of a running cable, which winds up thereon in a guide roller and is held on the upper side of the window, and a winding cable, which is fastened to the roller bar and rotates it by means of a winding roller.

The object of the present invention is to provide an improved device for rolling up and unrolling a material web onto and from a shaft, which device comprises fewer components, is simpler to install, and ensures sufficient tension of the material web irrespective of the roll-out length thereof, and in which the shaft is further reliably driven, in particular in an arrangement in which the material web is unrolled from the shaft obliquely or horizontally.

This object is achieved by a device having the features of claim 1 for rolling up and unrolling a material web onto and from a shaft. Advantageous embodiments are disclosed in the dependent claims.

More precisely, in the device according to the invention, a first radial distance assigned to any given roll-out length of the material web, between the material web and an axis of rotation of the shaft, differs from a second radial distance assigned to this roll-out length, between a tensioning rope and the axis of rotation of the shaft. This ensures that even for horizontal application of the device, in which the material web is to have a largely horizontal orientation when unrolled, the material web is reliably wound onto or from the central portion of the shaft when a force is exerted on the shaft via the tensioning ropes.

A force transmitted to the shaft via the tensioning ropes acts on the points of the rim portions at which the tensioning ropes separate tangentially from the corresponding rim portions of the shaft. Since the tensioning ropes are connected to the material web via the shaft, this force is exerted on the holding structure, which applies a counter force in accordance with Newton's third law (force=counter force). This counter force acts on the contact point between the material web and the central portion of the shaft, and acts in the opposite direction from the force transmitted by the tensioning rope, in accordance with Newton's concept of reaction. Because of the different radial distance of the material web from the axis of rotation and of the tensioning ropes from the axis of rotation, a first torque exerted on the shaft via the material web differs from a second torque exerted via the tensioning ropes. The first torque and the second torque are opposite in direction, but have different absolute values, since the first distance is different from the second distance. This results in a difference torque which drives the shaft.

The torque difference corresponds to the product of the exerted force with the difference between the first radial distance and the second radial distance. In other words, this acts on the contact point between the material web and the circumference of the central portion of the shaft and causes the shaft to rotate.

In the device according to the invention, the tensioning ropes serve both to tension the material web and to guide the shaft, and further serve to drive the shaft, and thus to roll up or unroll the material web onto or from the central portion of the shaft. The device according to the invention merely comprises three essential components, specifically the material web, the shaft onto or from which the material web is wound or unwound, and two tensioning ropes, which can be rolled and unrolled on the rim regions of the shaft. The device according to the invention therefore only has a few components, and so it is particularly simple to manufacture and to install. Further the small number of components means that the device according to the invention is less fault-prone.

Preferably, the tensioning ropes are made resilient, and when tensioned exert a force directed away from the holding structure onto the shaft, in such a way that the shaft is driven by means of the force exerted by the tensioning ropes. An embodiment of this type has the advantage that no separate force exertion means, such as an electric motor or the like, has to be used for the shaft to be driven.

Preferably, the device comprises a force storage device, which is operatively connected to the tensioning ropes and exerts a force directed away from the holding structure on the tensioning ropes. As a result, the shaft can be driven by means of the force exerted by the force storage device. The force storage device may for example consist of a tension spring or else of two tension springs or a plurality of tension springs.

Preferably, the first distance assigned to any given roll-out length of the material web, between the material web and the axis of rotation, is greater than the second distance assigned to this roll-out length, between the tensioning rope and the axis of rotation. An embodiment of this type ensures that the first torque exerted on the shaft via the material web is greater than the second torque exerted on the shaft via the tensioning ropes. As a result of the torque difference between the first torque and the second torque, the shaft is driven away from the holding structure by the force transmission via the tensioning ropes. In other words, the torque difference between the first torque and the second torque acts on the contact point of the material web on the circumference of the central portion of the shaft, and so the shaft is driven as a result of this torque difference in such a way that it moves away from the holding structure.

As a result, in an embodiment of this type of the device, the material web is always unrolled from the central portion of the shaft when the shaft is not fixed in position; this fixing may be provided for example by a fixing means.

On the other hand, the first distance assigned to any given roll-out length of the material web, between the material web and the axis of rotation, may preferably be smaller than the second distance assigned to this roll-out length, between the tensioning rope and the axis of rotation. As a result, the first torque exerted on the shaft via the material web is smaller than the second torque exerted on the shaft via the tensioning ropes, and so the shaft is driven towards the holding structure by the force transmitted via the tensioning ropes as a result of the torque difference between the first torque and the second torque. In other words, the torque difference between the first torque and the second torque acts on the contact point of the tensioning ropes on the circumferences of the rim portions, and brings about rotation of the shaft towards the holding structure. This ensures that the material web is always rolled up completely on the shaft by the action of a force, more precisely a tensile force on the tensioning ropes, if the shaft is not fixed in position; this fixing may be provided for example by a fixing means.

Preferably, the rim portions of the shaft are made cylindrical. A configuration of this type is particularly simple and cost-effective.

Preferably, the two rim portions of the shaft are formed conically along the respective axial extensions thereof, at least in part, and therefore taper from a first diameter to a second diameter along the respective axial extensions thereof. The first, larger diameter may be adjacent to the central portion of the shaft; however, conversely, the second, smaller diameter may also be adjacent to the central portion of the shaft.

A configuration of this type of the rim regions of the shaft means that a tension of the material web can be maintained during the rolling and unrolling movement of the shaft and a corresponding rolling and unrolling of the material web onto and from the shaft, since the diameter of the material web, which varies with the roll-out length off the material web, is compensated by the varying diameter of the tensioning ropes on the rim portions of the shaft.

Preferably, when the shaft is rotated in the unrolling direction, for which the material web unrolls from the central portion of the shaft, the respective tensioning ropes on the respective rim portions of the shaft are rolled in the direction of the tapering of the rim portions. This ensures that the tension of the material web is sufficiently maintained, since when the material web is unrolled from the central portion of the shaft the first radial distance between the material web and the axis of rotation decreases as the roll-out length of the material web increases, and so this decreasing radial first distance is compensated in that the respective tensioning ropes are rolled up in the direction of the tapering of the rim portion during the roll-up movement of said ropes.

As the roll-out length of the material web increases, the tensioning ropes, which exert a tensile force, and/or the force storage device, for example in the form of a tension spring, become shorter. As a result of this shortening, the tensioning ropes and/or the force storage device exert a smaller force, in accordance with Hook's law. To compensate this force decreasing during the unrolling process of the material web, the difference between the first distance, between the material web and the axis of rotation, and the second distance, between the tensioning rope and the axis of rotation, preferably increases as the roll-out length of the material web increases. This ensures that the torque difference between the first torque and the second torque remains substantially constant over the entire roll-out length of the material web, in such a way that the shaft is driven with a constant torque, and the material web is therefore unrolled from the shaft at a constant unrolling speed.

On the other hand, when the shaft is rotated in the roll-up direction, for which the material web is rolled up on the central portion of the shaft, the respective tensioning ropes are preferably unrolled from the respective rim portions of the shaft in the direction of the widening of the rim portions.

Preferably, the difference between the second distance, between the tensioning rope and the axis of rotation, and the first distance, between the material web and the axis of rotation, becomes smaller in the process, in such a way that the torque difference remains substantially constant over the entire roll-out length of the material web.

Specifically, as the roll-out length of the material web decreases, the tensioning ropes and/or the force storage device become shorter, in such a way that they exert a smaller force. This force reduction is compensated by the increasing difference between the second distance and the first distance, in such a way that the shaft is driven in the direction of the holding structure at an approximately constant speed by the exerted force.

Preferably, the device comprises a tensioning means, which is operatively connected to the tensioning ropes and/or the force storage device, for tensioning the tensioning ropes and/or the force storage device. This has the advantage that, depending on the angular orientation of the unrolled material web and depending on the forces therefore required for unrolling or rolling up the material web, a correspondingly adapted bias can be applied. A tensioning means of this type may for example be provided in the form of a tension lock.

Preferably, the device further comprises an operating element, which is connected to an end face of the shaft in the region of the axis of rotation so as to be rotatable and which may for example be configured as an operating rope, operating lever or operating chain. By means of the operating element, a force can be applied to the shaft by hand and/or by a motor. If the force storage device and/or the tensioning ropes are mostly slack, the shaft can be displaced back into an initial position, counter to the force exerted by the tensioning ropes and/or by the force storage device, by means of the operating element, in such a way that the tensioning ropes and/or the force storage device are tensioned again.

In a further preferred embodiment, the device further comprises an additional shaft, on the circumference of which the first fastening end of the material web is directly fastened, in such a way that the material web can be rolled up and unrolled on a central portion of the additional shaft by rotating the additional shaft about an axis of rotation. In each of the two axial end regions thereof, the additional shaft comprises a rim portion, on the respective circumference of which a respective additional tensioning rope is fastened, it being possible to roll up and unroll the additional tensioning ropes on the respective rim portions by rotating the additional shaft and to fasten them to the holding structure. Rotating the additional shaft in an unrolling direction, making the additional shaft move towards the holding structure, causes the material web to unroll from central portion of the additional shaft and the additional tensioning ropes to be rolled up on the respective rim portions of the additional shaft. Rotating the additional shaft in a roll-up direction, making the additional shaft move away from the holding structure, causes the material web to roll up on the central portion of the additional shaft and the tensioning ropes to be unrolled from the respective rim portions of the shaft. A first radial distance assigned to any given roll-out length of the material web, between the material web and the axis of rotation, differs from a second radial distance assigned to this roll-out length, between the additional tensioning rope and the axis of rotation of the central shaft, in such a way that a first torque, exerted on the additional shaft via the material web, differs in direction and magnitude from a second torque, exerted on the additional shaft via the additional tensioning ropes, in such a way that the additional shaft is driven by the force transmitted via the additional tensioning ropes as a result of the difference between the first torque and the second torque.

By way of a device of this type, a shading or screening surface may for example be displaced variably back and forth in space, without the material web having to be fastened to the holding structure and therefore ending there. Thus, for example, a shading or screening surface can be created which appears not to be in contact with a fastening structure and thus appears to be mounted freely in space.

Further advantages, details and features of the invention may be taken from the embodiments described in the following. In the drawings, in detail:

In the following description, like reference numerals denote like components or like features, and so a description given for a component in reference to one drawing also applies to the other drawings, avoiding repeating the description.

Figure 1:
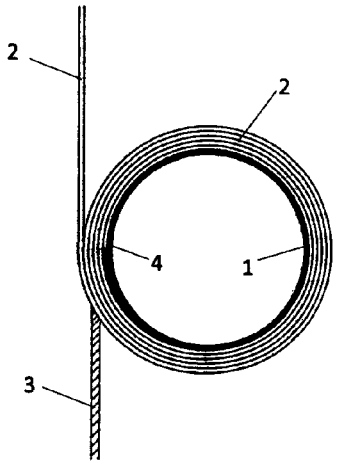
FIG. 1 is a section through a shaft having a rolled-up, flexible material web and having a tensioning rope fastened to the shaft.

FIG. 1 is a cross section through a shaft 1, on the circumference of which a second fastening end of a material web 2 is fastened. The material web 2 is wound up on the shaft 1, and separates from the shaft at a tangent point, at which the material web extends vertically upwards in the orientation shown in FIG. 1.

Figure 2:
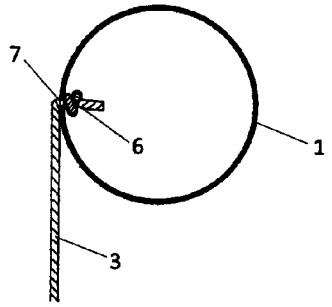
FIG. 2 is a section through the shaft along with a tensioning rope fastened thereto.

As can be seen from FIG. 2, a tensioning rope 3 is fastened on the circumference of the shaft 1 in that an end of the tensioning rope 3 protrudes through an opening in the circumference of the shaft 1 and is knotted together inside the shaft to form a knot 6, in such a way that tensioning rope fixing 7 is provided. The tensioning rope 3 and the material web 2 are arranged in such a way that the tensioning rope 3 is rolled up on the shaft 1 when the material web 2 is unrolled from the shaft 1. On the other hand, in FIGS. 1 and 2, if the shaft 1 is rotated anticlockwise, the material web 2 is rolled up on the shaft 1, whilst the tensioning rope 3 is unrolled from the shaft 1.

Figure 3:
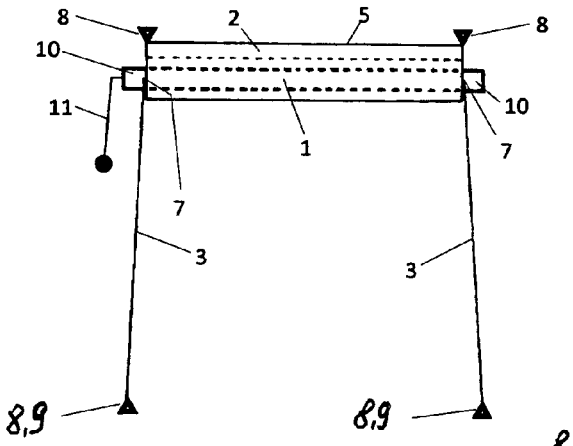
FIG. 3 is a front view or plan view of the device according to the invention, in which the material web is rolled up on the shaft.

FIG. 3 is a schematic front view or plan view of the device according to the invention. The material web 2 comprises a first fastening end 5, at which the material web 2 is fastened to a holding structure 8. The holding structure 8 may for example be brickwork or any other holding structure. As explained previously above in reference to FIG. 1, a second fastening end 4 is fastened to the circumference of the shaft 1. In FIG. 3, the material web 2 is rolled up completely on the shaft 1.

In each of the two axial end regions thereof, the shaft 1 comprises a rim portion 10, which is adjacent to the central portion and on the respective circumference of which a tensioning rope 3 is fastened in each case. The tensioning ropes 3 can be rolled up and unrolled on the rim portions 10 by rotating the shaft 1. The other ends of the tensioning ropes 3 are in turn fastened to a holding structure 8 or to a tensioning rope fastening means 9. The tensioning ropes 3 have a particular tension, in such a way that the shaft 1 is guided in the movement thereof when the material web 2 is rolled up or unrolled onto or from the shaft 1. Rotating the shaft 1 in an unrolling direction causes the shaft 1 to move away from the holding structure 8. In the process, the material web 2 is unrolled from the central portion of the shaft 1, and at the same time the tensioning ropes 3 are rolled up on the respective rim portions 10 of the shaft 1.

Figure 4:
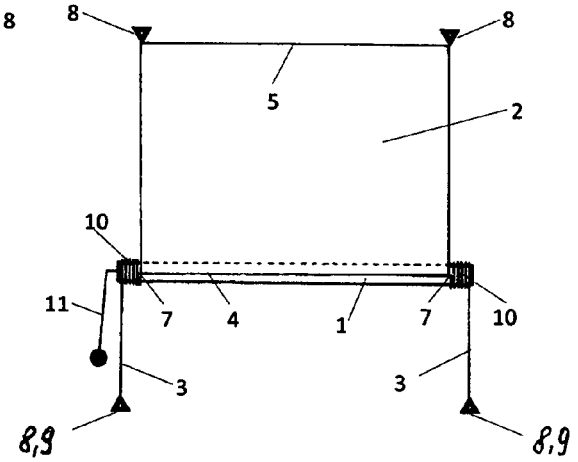
FIG. 4 is a front view or plan view of the device according to the invention, in which the material web is unrolled from the shaft.

FIG. 4 shows the device with the material web 2 unrolled in part from the central portion of the shaft 1. Unrolling of the material web 2 from the central portion of the shaft 1 is therefore accompanied by the tensioning ropes 3 being rolled up on the rim portions 10 of the shaft 1.

The device further comprises an operating element 11, which is connected to an end face 13 of the shaft 1 in the region of the axis of rotation so as to be rotatable and which may for example be configured as an operating rope 11, operating lever 11 or operating chain 11. By means of the operating element 11, the shaft can be moved upwards and/or downwards, in such a way that during a downwards movement the material web 2 unrolls from the central portion of the shaft 1 and during an upwards movement of the shaft 1 the material web 2 is rolled up on the central portion of the shaft 1.

Figure 5:
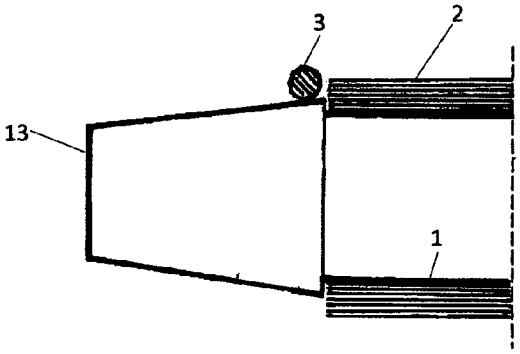
FIG. 5 is a section through part of the central portion of the shaft and through an end region of the shaft, the material web being wound up on the central portion and the tensioning rope being unrolled from the rim portion.
Figure 6:
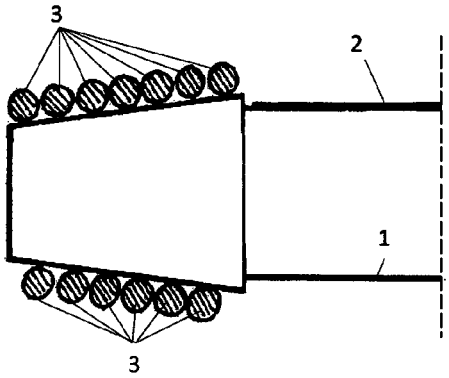
FIG. 6 shows the device of FIG. 5, the material web being unrolled from the central portion and the tensioning rope being rolled up on the rim portion.
Figure 7:
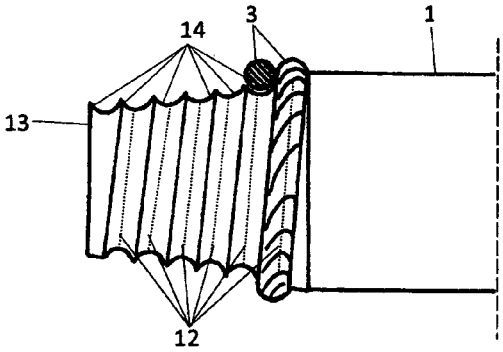
FIG. 7 is a section through an end region of the central portion of the shaft and through a rim portion of the shaft, which region comprises guide channels for the tensioning rope.

FIG. 5 is a section through part of the central portion and through a rim portion 10 of the shaft 1 of the device, in a situation where the material web 2 is mostly rolled up on the shaft 1 and the tensioning rope 3 is mostly unrolled from the rim portion 10. This situation corresponds to the state of the device shown in FIG. 3. FIG. 6 is a cross section of the same region of FIG. 5, but in FIG. 6 the material web 2 is mostly unrolled from the shaft 1 and the tensioning rope 3 is mostly rolled up on the rim portion 10 of the shaft 1. This situation corresponds to the situation shown in FIG. 4.

It can be seen from FIGS. 5 and 6 that the rim portion 10 of the shaft 1 is formed conically along the axial extension thereof and tapers along the axial extension thereof from a first diameter to a second diameter. This conical shaping of the rim portion 10 has the purpose that the material web 2 always remains uniformly or approximately uniformly tensioned irrespective of a roll-out length L of the material web 2. This is because a first radial distance R1 between the material web 2 and the axis of rotation of the shaft 1 decreases when the material web 2 is rolled out. This first radial distance R1, which decreases in the process of unrolling the material web 2 from the shaft 1, has to be compensated in that a second radial distance R2 between the tensioning rope 3 and the axis of rotation decreases significantly when the tensioning rope 3 is rolled up on the rim portion 10. As a result, when the material web 2 is unrolled from the shaft 1, the length of material web 2 unrolled is exactly the same as the length of the tensioning rope 3 rolled up on the rim portions 10.

So that the tensioning rope 3 is always present at the correct radius during rolling up on the rim portion 10 of the shaft 1, the rim piece 10 may comprise guide channels 14, in such a way that the tensioning rope 3 is positioned on a roll-up line 12 when wound up.

Figure 8:
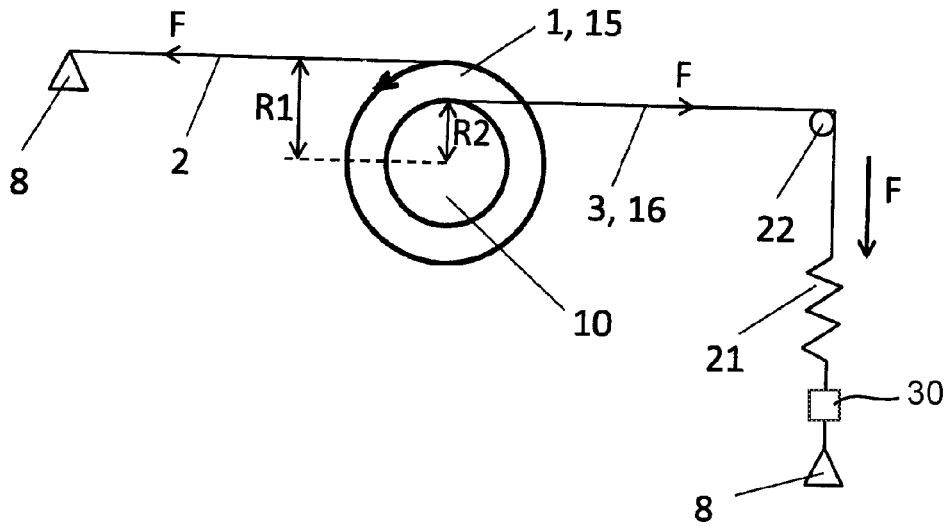
FIG. 8 is a schematic side view of the device according to the invention, in which a first radial distance between the material web and the axis of rotation is greater than a second radial distance between the tensioning rope and the axis of rotation.

FIG. 8 is a schematic side view of the device according to the invention in a situation where the material web 2 is already unrolled in part from the central portion of the shaft 1. In the situation shown in FIG. 8, the roll-out length L of the material web, which represents the length of the unrolled material web 2 from the holding structure 8 to the contact point between the material web 2 and the shaft 1, is approximately 50% of the maximum roll-out length L.

In the situation shown in FIG. 8, the tensioning rope 3 is rolled up in part on the circumference of the rim portion 10 of the shaft 1. The tensioning rope 3 is deflected about a deflection means 22 and is connected to a force storage device 21 in the form of a tension spring 21. The force storage device 21 itself is in turn connected to a holding structure 8 though a tension lock 30.

The force storage device 21 exerts a tensile force F on the tensioning ropes 3. As a result of Newton's third law and the connection between the tensioning rope 3 and the material web 2 via the shaft 1, the holding structure 8, to which the second fastening end 4 of the material web 2 is connected, exerts an opposing counter force on the material web 2. The counter force exerted by the holding structure 8 is identical in magnitude to the tensile force F exerted on the tensioning rope 3 by the force storage device 21, but orientated in the opposite direction.

It can be seen from FIG. 8 that a first radial distance R1 between the material web 2 and the axis of rotation of the shaft 1 is greater than a second radial distance R2 between the tensioning ropes 3 and the axis of rotation of the shaft 1. As a result, the first torque exerted on the shaft 1 via the material web 2 is greater than the second torque exerted on the shaft 1 via the tensioning ropes 3, since the first radial distance R1 is greater than the second radial distance R2 and the force acting on the circumference of the central portion of the shaft 1 is identical in magnitude to the tensile force F acting on the circumference of the rim portion 10 of the shaft 1. The two torques are in opposite directions, resulting in a difference torque. Since the first torque exerted on the shaft 1 via the material web 2 is greater than the second torque exerted on the rim portions 10 of the shaft via the tensioning ropes, and since the first torque brings about an anticlockwise rotation of the shaft in FIG. 8, the difference torque likewise brings about an anticlockwise rotation of the shaft 1 in FIG. 8. When the shaft 1 rotates anticlockwise, the material web 2 unrolls from the central portion of the shaft 1, the tensioning ropes 3 simultaneously being rolled up on the rim portion 10 of the shaft 1.

In other words, the difference torque acts on the point of the shaft 1 at which the material web 2 leaves the shaft 1.

In FIG. 8, the material web 2 is orientated horizontally when unrolled. This represents an idealised situation. Usually, the shaft 1 sags a little, and so the angle between the material web 2 and the tensioning ropes 3 is not 180° but a smaller angle. However, since the respective radial distances between the material web 2 and the axis of rotation and between the tensioning rope 3 and the axis of rotation do not change, the force ratios for a shaft 1 which sags in this way are the same as those disclosed above.

If the material web 2 is orientated obliquely rather than horizontally when unwound, not only the force F generated by the force storage device 21 acts on the shaft 1, but also a downhill component of gravity, which additionally contributes to unrolling the material web 2 from the shaft 1.

In the device according to the invention, it is therefore ensured that the unrolled material web 2 is tensioned by the tensioning rope 3 and moreover the tensioning rope 3 drives the shaft 1.

During the unrolling movement of the shaft 1, the force storage device 21 contracts, in such a way that during the unrolling movement the force exerted by the force storage device 21 decreases as the roll-out length L of the material web 2 increases. As a result, for a constant difference between the first radial distance R1 and the second radial distance R2, the shaft 1 is pulled towards the end position of the shaft 1 by the force storage device 21 more slowly as the roll-out length L increases.

Figure 9:
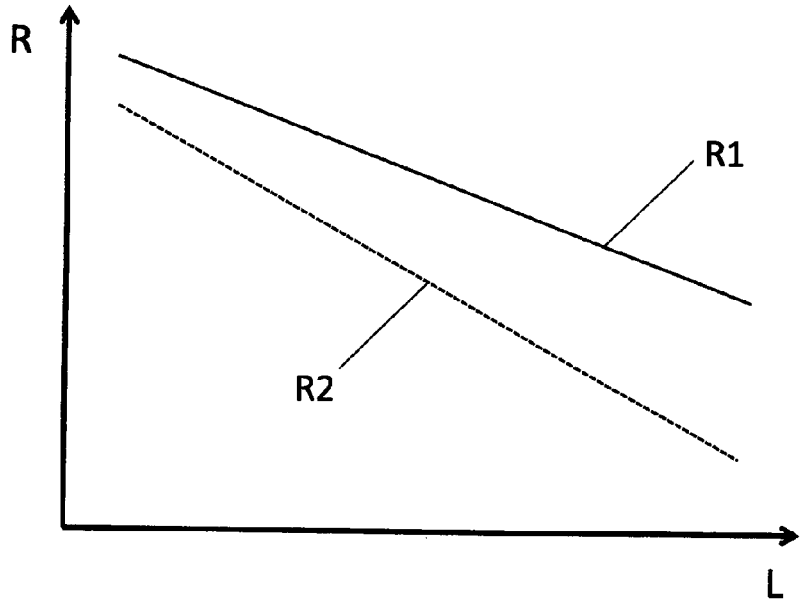
FIG. 9 is a diagram showing the first radial distance and the second radial distance as functions of the roll-out length of the material web.

However, so that the torque difference remains substantially constant over the entire roll-out length L of the material web 2, the shape of the rim portions 10 may be adapted in such a way that the difference between the first distance R1, between the material web 2 and the axis of rotation of the shaft 1, and the second distance R2, between the tensioning rope 3 and the axis of rotation of the shaft 1, increases as the roll-out length L of the material web 2 increases. A relationship of this type is shown in FIG. 9, from which it can be seen that the second radial distance R2 between the tensioning rope 3 and the axis of rotation falls more steeply than the first radial distance R1 between the material web 2 and the axis of rotation as the roll-out length L of the material web 3 increases. As a result, the force F, which decreases as the roll-out length L of the force storage device 21 increases, is compensated in that the difference between the first radial distance R1 and the second radial distance R2 increases. The product of the tensile force F and the difference between the radial distances R2 and R2 thus remains approximately constant. This ensures that the shaft 1 is transferred from an initial position into an end position at a constant or substantially constant speed over the entire roll-out length L.

Figure 10:
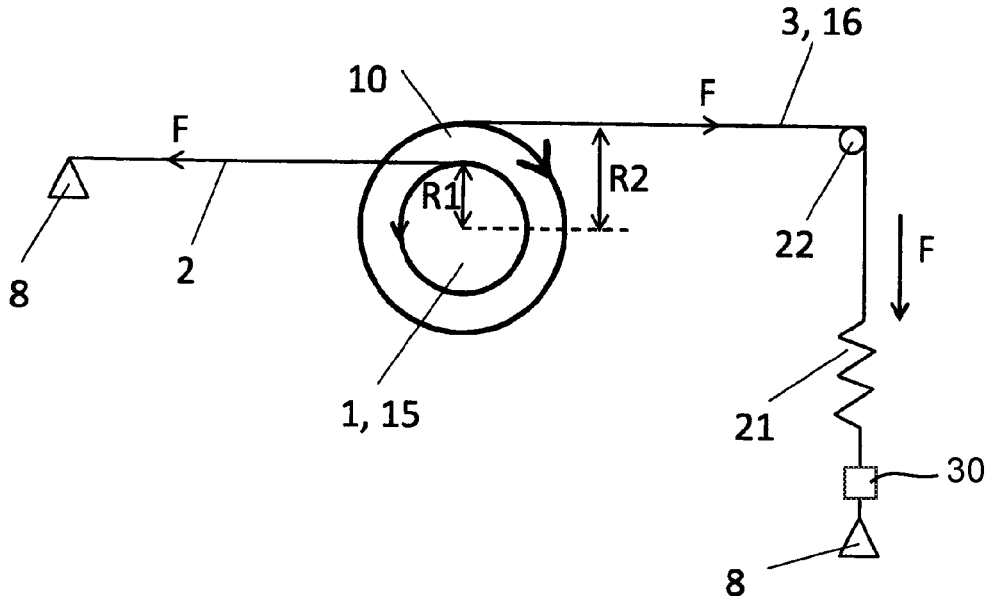
FIG. 10 is a schematic side view of the device according to the invention, in which the first radial distance between the material web and the axis of rotation is smaller than the second radial distance between the tensioning rope and the axis of rotation.

Whereas FIG. 8 is a side view of the device according to the invention, in which the material web 2 is unrolled from the shaft 1 as a result of the exertion of force by the force storage device 21, FIG. 10 shows the device according to the invention with the material web 2 being rolled up on the shaft 1 as a result of the tensile force F exerted by the force storage device 21. For this purpose, for any given roll-out length L of the material web 2, the first distance R1 between the material web 2 and the axis of rotation has to be smaller than the second radial distance R2 assigned to this roll-out length, between the tensioning rope and the axis of rotation.

As a result, the first torque exerted via the shaft 1 via the material web 2 is smaller than the second torque exerted on the shaft 1 via the tensioning rope 3. The scalar magnitudes of the first and the second torque are represented symbolically by different-size arrows in FIG. 10. The directions of the respective arrows indicate the directions in which the respective torques drive the shaft 1. Because of the effect of the difference torque, the shaft 1 in the drawing of FIG. 1 is rotated clockwise, the material web 2 being rolled up on the central portion of the shaft 1.

Figure 11:
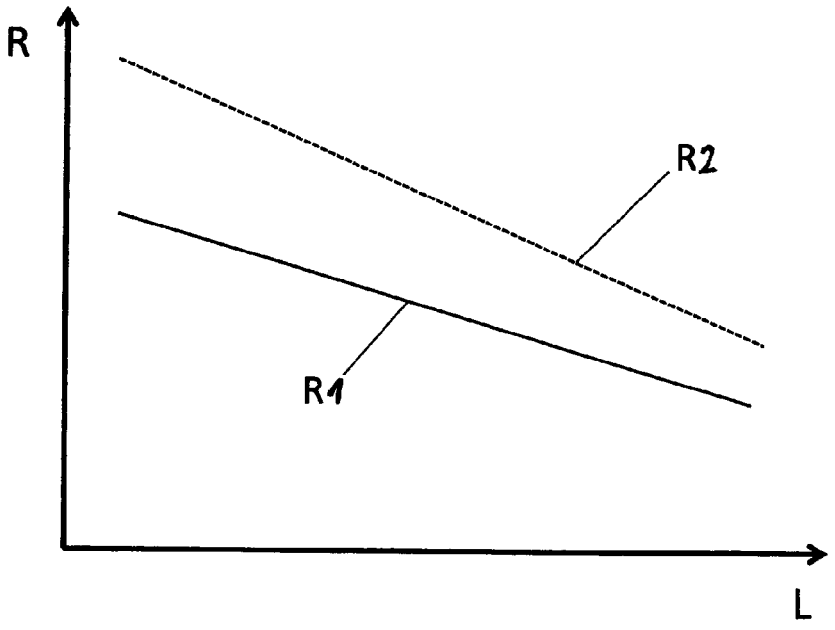
FIG. 11 is a diagram showing the first radial distance and the second radial distance as functions of the roll-out length of the material web.

In the embodiment shown in FIG. 10, the force storage device 21 is maximally tensioned when the material web 2 is completely unrolled from the shaft 1, in other words when the shaft 1 is located furthest to the right in the drawing of FIG. 10. When the force storage device 21 contracts and thus becomes slack, the shaft 1 moves towards the second fastening end 4 of the material web 2 as a result of the resultant torque. As a result of the contraction of the force storage device 21, the force F exerted by the force storage device 21 decreases as the roll-out length L of the material web 2 decreases. However, so that the shaft 1 is transferred into the end position thereof by the force storage device 21 at a constant speed, the difference torque has to be constant. To achieve this, as shown in FIG. 11, the difference between the second distance R2, between the tensioning rope 3 and the axis of rotation, and the first distance R1, between the material web 2 and the axis of rotation, may decrease as the roll-out length L of the material web increases. As a result, the torque difference can be kept substantially constant over the entire roll-out length L of the material web 2, in such a way that the roll-up speed of the shaft 1 remains substantially constant.

Figure 12:
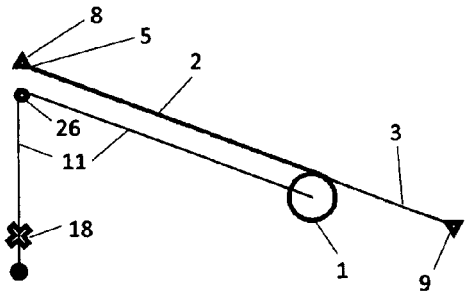
FIG. 12 is side view of the device according to the invention, along with an operating element fastened to the shaft, the material web having an oblique orientation.

FIG. 12 is a schematic side view of the device according to the invention, a force storage device 21 not being shown in the device. The tensioning ropes 3 may for example be made resilient, in such a way that they develop the tensile force F themselves. It can be seen from FIG. 12 that the device comprises an operating element 11, in the form of an operating rope 11, connected to the end face 13 of the shaft in the region of the axis of rotation so as to be rotatable. The operating rope 11 is deflected by an operating element deflection system 26, in such a way that the operating rope 11 hangs vertically downwards after being deflected by the operating element deflection system 26. When the shaft 1 is located in the end position as a result of the exertion of force via the force storage device 21 (not shown) and/or as a result of an exertion of force by the resilient tensioning ropes 3, in other words when the material web 2 is completely unwound from the shaft 1, the shaft 1 can be transferred back into the initial position thereof by pulling the operating rope 1, the tensioning rope 3 being tensioned or the force storage device 21 (not shown) being tensioned by pulling on the operating rope 1. By fixing the operating rope 11 by means of an operating element fixing system 18, the shaft 1 can be held in any desired position.

The operating rope 11 or operating element 11 need not necessarily be actuated by hand, but may also alternatively be driven by a motor.

Figure 13:
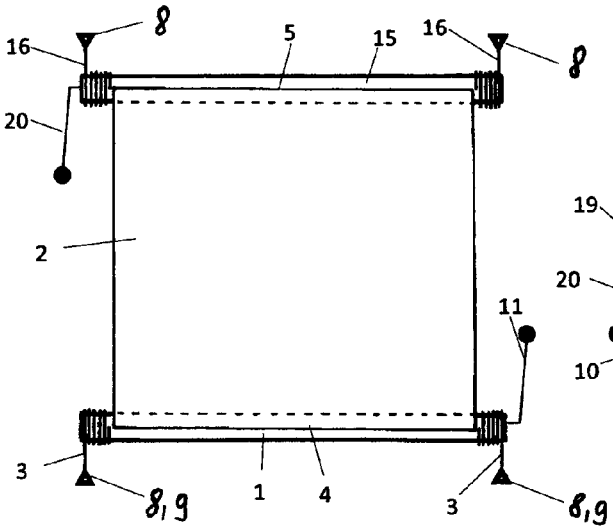
FIG. 13 is a front view or plan view of the device according to the invention in a further embodiment, which comprises two shafts on which the material web can be wound up, the material web being unrolled from the two shafts.

FIG. 13 shows an alternative embodiment of the device according to the invention, in a situation when the material web 2 is completely unrolled. As well as the shaft 1, the device comprises an additional shaft 15, on the circumference of which the first fastening end 5 of the material web 2 is fastened in such a way that the material web 2 can be rolled up and unrolled on a central portion of the additional shaft 15 by rotating the additional shaft 15 about an axis of rotation. In the two axial end regions thereof, the additional shaft 15 in each case comprises a rim portion 10, on the respective circumference of which an additional tensioning rope 16 is fastened in each case. The two additional tensioning ropes 16 can be rolled up and unrolled on the respective rim portions 10 of the additional shaft 15 by rotation, and can be fastened to the holding structure 8.

Rotating the additional shaft 15 in an unrolling direction, making the additional shaft 15 move towards the holding structure 8, causes the material web 2 to unroll from the central portion of the additional shaft 15, and at the same time, during this unrolling rotation the additional tensioning ropes 16 are rolled up on the respective rim portions 10 of the additional shaft 15. On the other hand, rotating the additional shaft 15 in a roll-up direction, making the additional shaft 15 move away from the holding structure, causes the material web 2 to roll up on the central portion of the additional shaft 15 and the additional tensioning ropes 16 to be unrolled from the respective rim portions 10 of the additional shaft 15. Just like the rim portions 10 of the shaft 1, the rim portions 10 of the additional shaft 15 are formed in such a way that a first radial distance R1 assigned to any given roll-out length L of the material web 2, between the material web 2 and the axis of rotation of the additional shaft 15, differs from a second radial distance R2 assigned to this roll-out length L, between the additional tensioning rope 16 and the axis of rotation of the additional shaft 15. As a result, a first torque exerted on the additional shaft 15 via the material web 2 differs in direction and magnitude from a second torque exerted on the additional shaft 15 via the additional tensioning ropes 16, in such a way that the additional shaft 15 is driven by a force exerted by the additional tensioning ropes 16 as a result of the torque difference between the first torque and the second torque.

Figure 14:
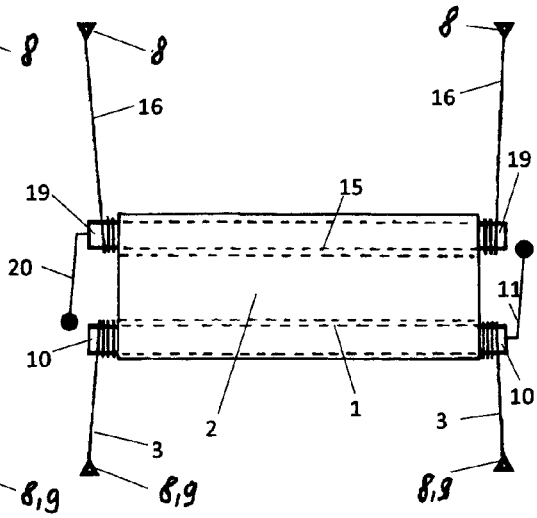
FIG. 14 showing the device of FIG. 13 with the material web mostly wound up on the two shafts.

FIG. 14 shows the device of FIG. 13 in a situation where the material web 2 is rolled up in part on the shaft 1 and on the additional shaft 15. As a result, the position of the unrolled material web 2 in a particular region between the holding structure 8 and the tensioning rope fastening means 9 is variable.

It can be seen from FIGS. 13 and 14 that an additional operating element 20 is connected to the additional shaft 15 at an end face 13 of the additional shaft in the region of an axis of rotation so as to be rotatable. The functionality and purpose of the additional operating element 20 are identical to those of the operating element 1, and so reference is made to the corresponding description above.

In an alternative embodiment (not shown in the drawings), the device according to the invention may comprise two deflection means 22, by means of which the tensioning ropes 3 and additional tensioning ropes 16 are respectively deflected. The tensioning ropes 3 may be interconnected and/or the additional tensioning ropes 16 may be interconnected. If the tensioning ropes 3 and/or the additional tensioning ropes 16 are resilient, the force required for the movement of the shaft 1 or additional shaft 15 is applied by the tensioning ropes 3 or additional tensioning ropes 16 themselves. Alternatively, a force storage device 21 in the form of a tension spring, to which the tensioning ropes 3 or additional tensioning ropes 16 are connected in each case, may be provided in each case between the tensioning ropes 3 and between the additional tensioning ropes 16. As a result of an embodiment of this type, merely a single tension spring is necessary on each side.

In a further embodiment (not shown), the device for rolling up and unrolling a material web 2 onto and from a shaft 1, 15 comprises a plurality of material webs 2, which can be rolled onto and from the shaft 1, 15 side by side. In this case, the operating rope 11 may be fastened on the shaft 1, 15 between the material webs 2.

LIST OF REFERENCE NUMERALS

1 shaft
2 material web
3 tensioning rope
4 second fastening end (of material web)
5 first fastening end (of material web)
6 knot
7 tensioning rope fixing
8 holding structure (for first fastening end)
9 tensioning rope fastening means
10 rim portion (of shaft or additional shaft)
11 operating element
12 roll-up line (of tensioning rope)
13 shaft end face
14 guide channels (for tensioning rope)
15 additional shaft
16 additional tensioning rope
18 operating element fixing system
19 rim portion (of additional shaft)
20 additional operating element
21 force storage device
22 deflection means (for a tensioning rope)
26 operating element deflection
30 tensioning means (tension lock)
F force (generated by tensioning rope or force storage device)
L roll-out length (of material web)
R radial distance
R1 first radial distance (between material web and axis of rotation)
R2 second radial distance (between tensioning rope and axis of rotation)

The invention claimed is:

1. Device for rolling up and unrolling a material web onto and from a shaft, the device further comprising two tensioning ropes and having the following features:

the material web comprises a first fastening end, at which the material web can be directly or indirectly fastened to a holding structure;

the material web comprises a second fastening end which is opposite the first fastening end and which is fastened to a circumference of the shaft in such a way that the material web can be rolled up and unrolled on a central portion of the shaft by rotating the shaft about an axis of rotation;

the shaft comprises a rim portion in each of two axial end regions of the shaft, a tensioning rope being fastened to a respective circumference of each of said rim portions, it being possible to roll up and unroll the tensioning ropes on the respective rim portions by rotating the shaft;

by rotating the shaft in an unrolling direction, making the shaft move away from the holding structure, the material web is unrolled from the central portion of the shaft and the tensioning ropes are rolled up on the respective rim portions of the shaft; and by rotating the shaft in a roll-up direction, making the shaft move towards the holding structure, the material web is rolled up onto the central portion of the shaft and the tensioning ropes are unrolled from the respective rim portions of the shaft, wherein a first radial distance assigned to any given roll-out length of the material web, between the material web and the axis of rotation, differs from a second radial distance assigned to this roll-out length, between the tensioning rope and the axis of rotation, in such a way that a first torque exerted on the shaft via the material web differs in direction and magnitude from a second torque exerted on the shaft via the tensioning ropes, in such a way that the shaft is driven by a force transmitted via the tensioning ropes as a result of the torque difference between the first torque and the second torque.

2. Device according to claim 1, wherein the tensioning ropes are resilient and when tensioned exert a force directed away from the holding structure on the shaft in such a way that the shaft is driven by the force exerted by the tensioning ropes.

3. Device according to claim 1, wherein the device further comprises a force storage device, which is operatively connected to the tensioning ropes and exerts a force directed away from the holding structure on the tensioning ropes, in such a way that the shaft is driven by the force exerted by the force storage device.

4. Device according to claim 1, wherein the first distance assigned to any given roll-out length of the material web, between the material web and the axis of rotation, is greater than the second distance assigned to this roll-out length, between the tensioning rope and the axis of rotation, in such a way that the first torque exerted on the shaft via the material web is greater than the second torque exerted on the shaft via the tensioning ropes, in such a way that the shaft is driven away from the holding structure by the force transmitted via the tensioning ropes as a result of the torque difference between the first torque and the second torque.

5. Device according to claim 1, wherein the first distance assigned to any given roll-out length of the material web, between the material web and the axis of rotation, is smaller than the second distance assigned to this roll-out length, between the tensioning rope and the axis of rotation, in such a way that the first torque exerted on the shaft via the material web is smaller than the second torque exerted on the shaft via the tensioning ropes, in such a way that the shaft is driven towards the holding structure by the force transmitted via the tensioning ropes as a result of the torque difference between the first torque and the second torque.

6. Device according to claim 1, wherein the two rim portions of the shaft are cylindrical.

7. Device according to claim 1, wherein the two rim portions of the shaft are formed conically along respective axial extensions thereof, at least in part, and taper from a first diameter to a second diameter along the respective axial extensions thereof.

8. Device according to claim 7, wherein when the shaft is rotated in the unrolling direction the respective tensioning rope is rolled up on the respective rim portions of the shaft in the direction of the tapering of the rim portions.

9. Device according to claim 8, wherein the difference between the first distance, between the material web and the axis of rotation, and the second distance, between the tensioning rope and the axis of rotation, increases as the roll-out length of the material web increases, in such a way that the torque difference is substantially constant over the entire roll-out length of the material web.

10. Device according to claim 7, wherein when the shaft is rotated in the roll-up direction the respective tensioning ropes are unrolled from the respective rim portions of the shaft in the direction of the widening of the rim portions.

11. Device according to claim 10, wherein the difference between the second distance, between the tensioning rope and the axis of rotation, and the first distance, between the material web and the axis of rotation, decreases as the roll-out length of the material web increases, in such a way that the torque difference is substantially constant over the entire roll-out length of the material web.

12. Device according to claim 3, wherein the force storage device comprises two force storage devices, which are each operatively connected to a tensioning rope.

13. Device according to claim 3, wherein the device further comprises a tensioning device, operatively connected to the tensioning ropes or to the force storage device, for tensioning the force storage device.

14. Device according to claim 1, wherein the device further comprises an operating element, which is connected to an end face of the shaft in a region of the axis of rotation so as to be rotatable or is placed in free rotation on the shaft, and which is configured as an operating rope, operating lever or operating chain, and by which a force can be applied to the shaft by hand or by a motor.

15. Device according to claim 1, wherein the following features:

the device further comprises an additional shaft, on the circumference of which the first fastening end of the material web is fastened, in such a way that the material web can be rolled up and unrolled on a central portion of the additional shaft by rotating the additional shaft about an axis of rotation;

in each of the two axial end regions thereof, the additional shaft comprises a rim portion, on the respective circumference of which a respective additional tensioning rope is fastened, it being possible to roll up and unroll said additional tensioning ropes on the respective rim portions by rotating the additional shaft and to fasten them to the holding structure;

rotating the additional shaft in an unrolling direction, making the additional shaft move towards the holding structure, causes the material web to unroll from central portion of the additional shaft and the additional tensioning ropes to be rolled up on the respective rim portions of the additional shaft;

rotating the additional shaft in a roll-up direction, making the additional shaft move away from the holding structure, causes the material web to roll up on the central portion of the additional shaft and the additional tensioning ropes to be unrolled from the respective rim portions of the shaft;

a third radial distance assigned to any given roll-out length of the material shaft, between the material web and the axis of rotation, differs from a fourth radial distance assigned to this roll-out length, between the additional tensioning rope and the axis of rotation of the additional shaft, in such a way that a first torque, exerted on the additional shaft via the material web, differs in direction and magnitude from a second torque, exerted on the additional shaft via the additional tensioning ropes, in such a way that the additional shaft is driven by the force transmitted via the additional tensioning ropes as a result of the torque difference between the first torque and the second torque.

* * * * *